US008783291B2

(12) United States Patent
Weixler et al.

(10) Patent No.: US 8,783,291 B2
(45) Date of Patent: Jul. 22, 2014

(54) SERVO VALVE

(75) Inventors: Franz Weixler, Kempten (DE); Florian Lau, Grünenbach (DE)

(73) Assignee: Liebherr-Aerospace Lindenberg GmbH, Lindenberg (DE)

( * ) Notice: Subject to any disclaimer, the term of this patent is extended or adjusted under 35 U.S.C. 154(b) by 646 days.

(21) Appl. No.: 12/894,457

(22) Filed: Sep. 30, 2010

(65) Prior Publication Data

US 2011/0079297 A1 Apr. 7, 2011

(30) Foreign Application Priority Data

Sep. 30, 2009 (DE) ..... 10 2009 047 901
Oct. 12, 2009 (DE) ..... 10 2009 049 493

(51) Int. Cl.
*F15B 13/04* (2006.01)
*F15B 13/043* (2006.01)

(52) U.S. Cl.
USPC ..... 137/625.63; 137/625.61

(58) Field of Classification Search
USPC ..... 137/625.6, 625.61, 625.63
See application file for complete search history.

(56) References Cited

U.S. PATENT DOCUMENTS

| | | | | | |
|---|---|---|---|---|---|
| 2,969,808 | A | * | 1/1961 | Horlacher | 137/625.63 |
| 3,017,864 | A | | 1/1962 | Atchley | |
| 3,228,423 | A | * | 1/1966 | Moog, Jr. | 137/625.62 |
| 3,331,383 | A | * | 7/1967 | Buchanan | 137/83 |
| 3,386,343 | A | | 6/1968 | Gray | |
| 3,612,103 | A | * | 10/1971 | Waddington | 137/625.63 |
| 5,553,827 | A | * | 9/1996 | Perkey | 251/30.01 |

* cited by examiner

*Primary Examiner* — John K Fristoe, Jr.
*Assistant Examiner* — Michael R Reid
(74) *Attorney, Agent, or Firm* — Dilworth & Barrese, LLP.

(57) ABSTRACT

The present invention relates to a two-stage electrohydraulic servo valve with a first stage, which operates as pilot stage and includes a movable nozzle tube, and a second stage which operates as power stage, wherein the nozzle tube of the pilot stage is guided by means of a torsion element and the oil supply of the movable nozzle tube is integrated in the torsion element.

18 Claims, 1 Drawing Sheet

SERVO VALVE

BACKGROUND OF THE INVENTION

The present invention relates to a two-stage electrohydraulic servo valve with a first stage, which operates as pilot stage and includes a movable nozzle tube, and a second stage which operates as power stage.

In modern hydrosystems engineering, particularly high demands often are placed on the operating behavior of the installed hydraulic components within such hydrosystem. In particular, the installed hydraulic components are meant to regulate certain hydraulic volume flows and pressures with high precision corresponding to given control signals. Valves suitable for this purpose, in particular continuous valves, allow to permit a continuous transition of the switching positions of the valve. In said continuous valves, an electrical input signal correspondingly is converted into a hydraulic output signal for actuating the continuous valve. One category of the continuous valves includes the well-known servo valves, which allow a highly precise and above all continuous adjustment of the valve switching position, which in particular in modern aircraft technology is regarded as a basic prerequisite.

From the prior art, so-called two-stage servo valves are known, whose power stage includes a control piston which in its starting position normally prevents the volume flow between a pressure input and a pressure output channel. Inside the power stage, the control piston is in a pressure equilibrium. For actuating the power stage, i.e. for the controlled deflection of the control piston, which permits a volume flow between an input channel and an output channel, an electrically actuatable pilot stage is used, which effects the required deflection of the control piston.

One embodiment of the pilot stage operates according to the known nozzle tube principle. For this purpose, a nozzle tube supplied with hydraulic fluid is movably articulated in a pivot point of the pilot stage. The pressure equilibrium of the control piston of the power stage in the zero-point position can be influenced by corresponding control lines connected to the nozzle tube. By means of the electrical control signals output to the pilot stage, the nozzle tube can be swivelled to and fro between the two control lines, whereby the pressure can be increased selectively to certain points of the control piston of the power stage. The change in pressure enforces a movement of the control piston out of the zero-point position, which corresponds to a continuous switching transition of the valve.

In the pilot stages known so far, the pressure supply of the nozzle tube is achieved by an external tube conduit, whose connection point is susceptible to the vibrations, pressure fluctuations and zero-point shifts occurring in the valve during the operation.

SUMMARY OF THE INVENTION

It is the object of the present invention to provide the skilled person with a two-stage servo valve which offers a more robust behavior in the case of vibrations and pressure fluctuations as well as a better behavior in the case of a zero-point shift.

The present invention is solved by the combination of features herein. Accordingly, in a two-stage electrohydraulic servo valve with a first stage, which operates as pilot stage and includes a movable nozzle tube, and a second stage which operates as power stage, the nozzle tube of the pilot stage is guided by means of a torsion element, wherein the oil supply of the movable nozzle tube is integrated in the torsion element. Accordingly, the pilot stage operates according to the known nozzle tube principle for actuating the power stage.

In accordance with the invention, it hence is omitted to solder an external tube to the nozzle tube for supplying the same with pressure, but the feed conduit for the pressure supply of the nozzle tube is integrated within the torsion element. Via the torsion element the nozzle tube is rotatably arranged about the torsion axis which extends in direction of the longitudinal axis of the torsion element. Due to this inventive arrangement of nozzle tube, torsion element and supply conduit, less parts must be moved in actual operation of the two-stage electrohydraulic servo valve. Consequently, advantages can be achieved thereby in terms of the dynamics of the electrohydraulic servo valve and the robustness with respect to vibration influences. The maximum angle of rotation of the nozzle tube is dependent on the elasticity and the length of the torsion element. The torsion of the torsion element also serves for resetting the nozzle tube. The oil supply is effected through the interior or cavity present in the torsion element. It is also conceivable, however, that for this purpose an extra conduit is provided in the interior of the torsion element.

Advantageously, the oil supply of the nozzle tube is arranged in the neutral fiber of the torsion element. The neutral fiber of the torsion element designates the region in which no bending stress occurs during a bending operation or a torsion. As a result, the loads acting on the oil supply inside the torsion element due to the occurring forces on the torsion element are reduced significantly, whereby a sufficient and satisfactory oil supply of the nozzle tube is ensured at any time. Consequently, the robustness with respect to vibrations and the valve dynamics as well as the switching precision of the valve are optimized.

The torsion element used preferably is a torsion bar spring in whose middle region the nozzle tube is arranged on the longitudinal axis. To obtain a symmetric rigidity in both branches of the torsion element, which extend laterally from the mounting point of the nozzle tube in both directions, it can be provided that in addition to the oil supply bore on one branch side of the torsion element a further bore is arranged on the opposite branch. The oil supply bore serves to supply fluid to the oil supply integrated in the torsion element. Particularly preferably, both of said bores are arranged symmetrically with respect to the connection point of the nozzle tube. As a result, there is not only achieved a symmetric rigidity in both branches of the torsion element, but the entire torsional rigidity of the torsion element also is reduced.

It is conceivable that the torsion element is made of copper-beryllium and/or of titanium and/or of steel. All three material variants represent a particularly stable and vibration-resistant design possibility of the torsion element.

To seal the connection of torsion element and nozzle tube and thus prevent a loss of hydraulic fluid, a seal can be provided at the connection of torsion element and nozzle tube in the pivot point. A radial O-ring seal is particularly preferred, which allows a complete sealing of the nozzle tube in the connection point to the torsion element and does not substantially influence the precision of the rotary movement of the nozzle tube for actuating the power stage.

Advantageously, the nozzle tube is connected with the torsion element by press fit, whereby a particularly stable and robust connection of the two elements is achieved.

It is conceivable that the bores inside the torsion element are closable or closed by means of ball bearing balls. It is also conceivable that the bores of the torsion element are closable or closed by means of cylindrical plugs instead of ball bearing balls, or a combination of the two closing techniques is employed.

Advantageously, the pilot stage includes a base plate. The same adjoins the region or the block of the power stage. The base plate serves to accommodate the torsion element, wherein the longitudinal axis of the nozzle tube takes a vertical position and is guided through the base plate in direction of the power stage or into the same. In particular, the sealing of the nozzle tube in the region of the pivot point of the torsion element is integrated in the base plate. This corresponds to a particularly stable and robust arrangement with respect to vibration influences which can act on the two-stage electrohydraulic servo valve.

It can be provided that the base plate is sealed with respect to the power stage or with respect to the block of the power stage by means of an axial seal. In particular, the axial seal is located in the region of the vertical extension of the nozzle tube between the base plate and the block of the power stage.

Since the oil supply of the nozzle tube extends out of the oil supply of the power stage. it is particularly advantageous that an oil supply conduit is guided through the base plate up to the torsion element. The further extension of the oil supply then is integrated within the torsion element up to the nozzle tube in accordance with the invention. Consequently, in the inventive arrangement of the two-stage electrohydraulic servo valve an external pressure supply of the nozzle tube is completely omitted. Soldering an external tube for pressure supply can be prevented, whereby a better and more robust behavior of the servo valve is obtained in the case of vibrations, pressure fluctuations and a zero-point shift.

For preservation and further sealing of the oil supply conduit it is advantageous to seal the same by means of an axial seal in the region between torsion element and base plate. What is conceivable here is the use of several sealing means, in particular in the region of the transition between the valve block of the power stage and the base plate as well as in the region between torsion element and base plate.

BRIEF DESCRIPTION OF THE DRAWINGS

Further features, advantages and details will now be explained in detail with reference to an embodiment illustrated in two drawings, in which.

DESCRIPTION OF THE PREFERRED EMBODIMENTS

Figure 1:
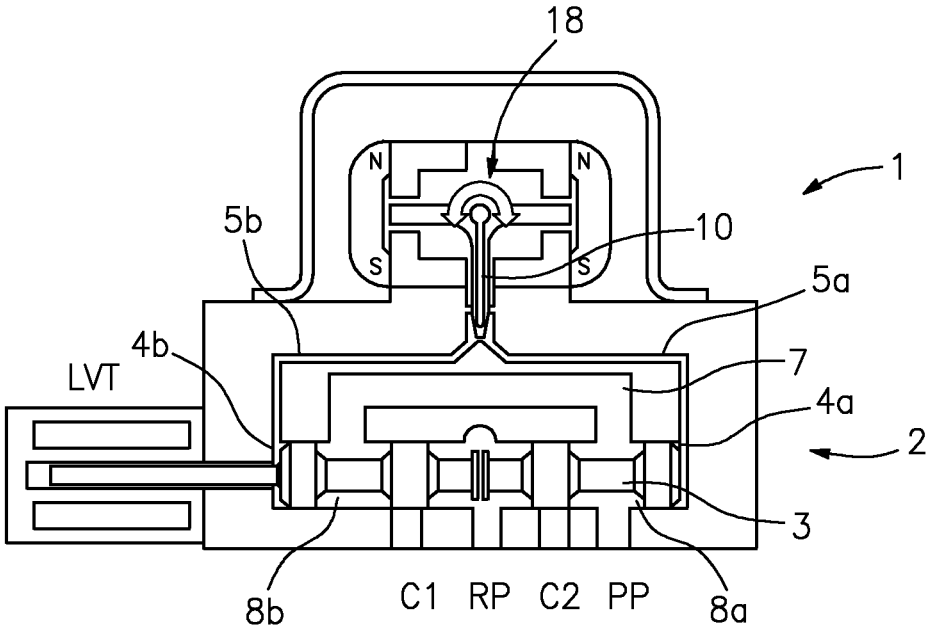
FIG. 1: shows a schematic representation of the two-stage electrohydraulic servo valve of the invention in a longitudinal section.

The basic construction of the two-stage electrohydraulic servo valve of the invention is illustrated in the longitudinal section of the valve as shown in FIG. 1. The servo valve consists of the unit pilot stage 1 and of the hydraulic power stage 2.

In the interior of the block of the power stage 2 a control piston 3 is movably mounted. On its bottom surface, the block of the power stage 2 includes a pressure inlet channel PP and the two pressure outlet channels C1 and C2. On the outside diameter of the control piston 3 control edges each are formed over the two pressure outlet channels C1 and C2, whose width in axial direction of the control piston 3 approximately corresponds to the diameter of the two outlet channels C1 and C2.

Via the pressure inlet opening PP a suitable hydraulic fluid, in particular a hydraulic oil, is introduced into the first pressure chamber 8*a* and passed on to the second pressure chamber 8*b* via the compensating conduit 7.

The starting position of the control piston 3 is referred to as so-called zero position, in which the control piston 3 is centrally mounted centered in the block of the power stage and is in pressure equilibrium. In said zero position, the control edges at the control piston 3 fully cover the two pressure outlet channels C1 and C2, so that no fluid flow is possible between the inlet channel PP and one of the two pressure outlet channels C1 and C2.

Figure 2:
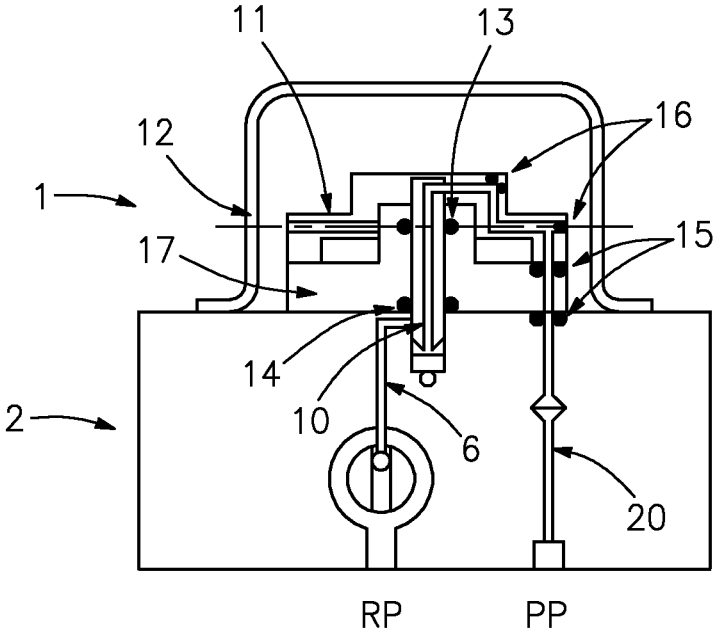
FIG. 2: shows a schematic representation of the two-stage electrohydraulic servo valve of the invention as shown in FIG. 1 in a cross-section.

FIG. 2 shows a cross-section along a cutting line extending approximately through the center of the servo valve of the invention. On the upper edge of the valve block of the power stage 2, the base plate 17 of the pilot stage 1 is arranged. The base plate 17 carries a torsion element 11, which is configured as torsion bar spring 11. The torsion bar spring 11 is rotatably mounted on the base plate 17 about the torsion axis 12, which extends in direction of the longitudinal axis of the torsion bar spring 11, with the two ends of the torsion bar spring 11 being firmly fixed at the base plate 17. Furthermore, FIG. 2 shows a step-like formation of the torsion bar spring 11, to whose central step a nozzle tube 10 is attached in a centered manner by means of a press fit. The longitudinal axis of the nozzle tube 10 extends in vertical direction proceeding from the torsion bar spring 11 through the base plate up into the valve block of the power stage 2. At the end of the nozzle tube 10, i.e. at the lower tube opening, the two control lines 5*a*, 5*b* are arranged inside the power stage 2 laterally offset with respect to the vertically extending nozzle tube 10.

By means of a suitable device, a force can be exerted on the nozzle tube 10, which initiates swivelling of the nozzle tube 10 against its vertical starting position. For example, the device can generate an electromagnetic field which acts on the nozzle tube 10 such that the same, as shown in FIG. 1, is swivelled either to the left or to the right in direction of arrow, whereby the opening of the nozzle tube 10 is approached either to the control line 5*a* or to the control line 5*b*. The control of the force acting on the nozzle tube 10, i.e. the amount of the electromagnetic field, is effected via electrical control signals which are transmitted to the pilot stage by an external valve control.

Due to the swivel movement of the nozzle tube 10, the torsion bar spring 11 simultaneously is rotated about the torsion axis 12 and inside the torsion bar spring 11 a torsional stress is created, which acts against the rotary movement of the nozzle tube 10. After reducing or shutting off the electromagnetic field, the nozzle tube 10 is set back in direction of its vertical starting position by the torsional stress inside the torsion bar spring 11. It remains to be mentioned that the deflection of the nozzle tube 10 is effected continuously by the valve controller. The maximum angle of rotation of the nozzle tube 10 as well as the relation between acting force and angle of rotation are dependent on the length and elasticity of the torsion bar spring 11.

The oil supply conduit 20 serves to supply the nozzle tube 10 with hydraulic oil. The same starts at the entrance of the pressure inlet channel PP of the valve block of the power stage 2 and extends in the same in vertical direction up to the base plate 17. In accordance with the invention, the oil supply by means of the oil supply conduit 20 is guided through the base plate 17 up to the torsion bar spring 11 and enters through a bore into the interior or cavity of the torsion bar spring 11.

Thus, the further oil supply up to the nozzle tube 10 now is effected completely inside the torsion bar spring 11 and thus extends from the inlet bore of the torsion bar spring 11 along the step shape of the torsion bar spring 11 up to the connection point of the nozzle tube 10 with the torsion bar spring 11. Therefore, the present invention does not make use of an external tube conduit of the pilot stage, but integrates the oil supply of the nozzle tube 10 completely inside the torsion element, in particular inside the torsion bar spring 11. The use of an external tube conduit, which is attached to the nozzle tube 10 by soldering, has a pronounced susceptibility to vibrations, pressure fluctuations and zero-point shifts. Due to the integration of the oil supply inside the torsion element in accordance with the invention, said wear point can be omitted, whereby substantial advantages can be achieved in terms of valve dynamics and in terms of robustness with respect to vibration influences.

Due to the lateral deflection of the nozzle tube 10, more or less pressure can be applied either to the control line 5*a* or to the control line 5*b*, whereby inside the control spaces 4*a* and 4*b* a changed pressure acts on the end faces of the control piston 3, which is continuously variable by means of the control signals.

For example, when a rotary movement of the nozzle tube 10 proceeding from a vertical axis to the left is effected by the corresponding electrical control signal, the opening of the nozzle tube approaches the control line 5*b*, whereby most of the hydraulic fluid emerging from the opening is discharged to the control line 5*b*. Consequently, the pressure inside the control space 4*b* increases. Inside the control space 4*b*, an increased pressure therefore acts on the end face of the control piston 3, which results in a displacement of the control piston 3 along its longitudinal axis to the right. Due to the movement of the control piston 3, the control edges above the pressure outlet channel Cl simultaneously are shifted to the right, whereby the channel Cl is opened. The fluid entering via the pressure inlet channel PP can exit from the servo valve via the compensating channel 7 and the chamber 8*b* through the pressure outlet channel Cl and for example supply a load connected to Cl with hydraulic oil. It is conceivable here that the oil recirculated from the load is recirculated to the valve via the pressure outlet channel C2 and is recirculated to the oil tank via the simultaneously opened connection of C2 and the return channel RP. The return spring 6 engaging in the control slide 3 is firmly connected with the nozzle tube 10 and now generates a more and more increasing reverse torque on the nozzle tube 10, until the same swivels back into the vertical neutral position. The pressures at the control spaces 4*a* and 4*b* then are the same. The control piston 3 stops in this position. The control piston stroke is proportional to the applied electrical control signal. Derived therefrom, the volume flow from PP to C1 or C2 to RP is proportional to the electrical signal applied.

Opening the pressure outlet channel C2 analogously is effected via a rotary movement of the nozzle tube 10 in direction of the control channel 5*a*.

All bores of the torsion bar spring 11, which on the one hand comprise the bore for the oil supply conduit 20 and on the other hand a bore on the opposite side of the torsion bar spring 11, optionally can be closed by means of ball bearing balls 16 or cylindrical plugs. To additionally seal the connection point of nozzle tube 10 and torsion bar spring 11 and thus prevent an unwanted loss of hydraulic fluid or pressure loss inside the servo valve, a radial O-ring seal 13 is arranged, in particular in the pivot point 18. In the transition region from the base plate 17 to the valve block of the power stage 2, the nozzle tube 10 furthermore is sealed by an axial seal 14. For further sealing of the oil supply conduit 20 a plurality of axial seals 15 are used, which are arranged in the region of the transition between base plate 17 and valve block of the power stage 2 as well as in the region of the torsion bar spring 11.

The invention claimed is:

1. A two-stage electrohydraulic servo valve with a first stage (1), which operates as pilot stage and includes a movable nozzle tube (10), and a second stage (2) which operates as power stage, wherein the first stage (1) additionally comprises an integral a torsion element (11), with the nozzle tube (10) of the pilot stage (1) mounted upon and guided by the integral torsion element (11) and an oil supply of the movable nozzle tube (10) integrated in the torsion element (11), a base plate (17), with opposite ends of the integral torsion element (11) affixed to the same base plate (17), and the second stage (2) comprises a control piston or slide (3) reciprocally mounted therein and a return spring (6) engaging the control piston or slide (3) and firmly connected with the nozzle tube (10) to generate an increasingly reverse torque on the nozzle tube (10) until the nozzle tube (10) swivels back into vertical neutral position.

2. The two-stage electrohydraulic servo valve according to claim 1, wherein the oil supply is located in the neutral fiber of the torsion element (11).

3. The two-stage electrohydraulic servo valve according to claim 1, wherein the torsion element (11) is a torsion bar spring.

4. The two-stage electrohydraulic servo valve according to claim 1, wherein the torsion element (11) has an oil supply bore on one side and an additional bore is provided on the opposite side.

5. The two-stage electrohydraulic servo valve according to claim 1, wherein the torsion element (11) is made of titanium.

6. The two-stage electrohydraulic servo valve according to claim 1, wherein the torsion element (11) is made of a copper-beryllium alloy.

7. The two-stage electrohydraulic servo valve according to claim 1, wherein the torsion element (11) is made of steel.

8. The two-stage electrohydraulic servo valve according to claim 1, wherein the nozzle tube (10) is connected with the torsion element (11) by press fit.

9. The two-stage electrohydraulic servo valve according to claim 4, wherein the bores in the torsion element (11) are closed by ball bearing balls (16).

10. The two-stage electrohydraulic servo valve according to claim 4, wherein the bores in the torsion element (11) are closed by means of cylindrical plugs.

11. The two-stage electrohydraulic servo valve according to claim 1, wherein the base plate (17) is sealed against the power stage (2) by an axial seal (14).

12. The two-stage electrohydraulic servo valve according to claim 1, wherein an oil supply conduit (20) is guided through the base plate (17) up to the torsion element (11).

13. The two-stage electrohydraulic servo valve according to claim 1, wherein an oil supply conduit (20) is sealed between torsion element (11) and base plate (17) by an axial seal (15).

14. The two-stage electrohydraulic servo valve according to claim 1, additionally comprising an oil supply bore extending through at least part of the torsion element (11) and arranged to communicate an oil supply conduit (20) with an internal channel of the movable nozzle tube (10).

15. The two-stage electrohydraulic servo valve according to claim 14, wherein the torsion element (11) has a step-like configuration, with the nozzle tube (10) being attached to a central step of the nozzle tube (10) by press fit.

16. The two-stage electrohydraulic servo valve according to claim 15, wherein the nozzle tube (10) is arranged with a longitudinal axis thereof extending in a vertical direction from the torsion element (11) through the base plate (17) and into a valve block of the second stage (2), with stationary control lines (5*a*, 5*b*) extending to stationary control spaces (4*a*, 4*b*) adjacent opposite ends of the control piston or slide (3) at ends of the control lines (5*a*, 5*b*) and, at opposite ends of the control lines (5*a*, 5*b*), being laterally offset with respect to the vertically-extending nozzle tube (10).

17. The two-stage electrohydraulic servo valve according to claim 16, wherein the control piston or slide (3) has variable diameter or cross-section along a length thereof, and additionally comprising two pressure outlet channels (C1, C2), a pressure inlet opening (PP) and a return channel (RP) opening into a space of the valve block containing the control piston or slide (3).

18. The two-stage electrohydraulic servo valve according to claim 1, wherein the second stage (2) comprises two control lines (5*a*, 5*b*) leading to control spaces (4*a*, 4*b*) at opposite end faces of the control piston (3), and with the nozzle (10) pivotally mounted to swivel between the two control lines (5*a*, 5*b*), and the spring (6) extends, in unbiased condition, along an axis of the nozzle (10) in the vertically neutral position of the nozzle (10) and between the two control lines (5*a*, 5*b*).

* * * * *